United States Patent [19]

McCauley

[11] 4,045,993

[45] Sept. 6, 1977

[54] FENDER FLANGING APPARATUS

[75] Inventor: Herbert J. McCauley, Buffalo, N.Y.

[73] Assignee: McCauley Metal Products, Inc., Buffalo, N.Y.

[21] Appl. No.: 746,862

[22] Filed: Dec. 2, 1976

[51] Int. Cl.[2] ..... B21D 7/06

[52] U.S. Cl. ..... 72/387; 72/319; 72/379

[58] Field of Search ..... 72/387, 380, 379, 375, 72/310, 319

[56] References Cited

U.S. PATENT DOCUMENTS

| | | | |
|---|---|---|---|
| 3,400,568 | 9/1968 | Brandner | 72/387 |
| 3,862,562 | 1/1975 | Kruger | 72/380 |
| 3,983,735 | 10/1976 | Berry | 72/379 |
| 3,994,152 | 11/1976 | Wolters | 72/319 |

*Primary Examiner*—C.W. Lanham
*Assistant Examiner*—Gene P. Crosby
*Attorney, Agent, or Firm*—Christel & Bean

[57] ABSTRACT

The illustrated apparatus forms a flange at the front or rear end of a bicycle fender, the end of the fender being generally arcuate as viewed in side elevation. The fender is supported on a shoe member having an arcuate end face with a portion of the fender projecting beyond such end face. A forming member of arcuate curvature is mounted for arcuate movement on an axis concentric with the common axis of curvature of the end of the support block and the arcuate forming member. The forming member has an inverted U-shaped forming edge which passes arcuately downwardly across the projecting end of the fender to cooperate with the end face of the support block to flange the projecting end of the fender downwardly.

7 Claims, 2 Drawing Figures

FENDER FLANGING APPARATUS

BACKGROUND OF THE INVENTION

This invention relates to apparatus for use in forming return vent flanges at the ends of fenders for bicycles and the like.

In the prior art the ends of fenders for bicycles and the like have usually presented sheet metal edges which are relatively sharp and thus present a substantial hazard in general use and more particularly in the event of collision or other accident.

It has been recognized that raw sheet metal edges on members of this general type may be avoided by providing bead formations or return vent flanges along sheet metal edges to present a rounded edge. However, in the case of bicycle fenders and the like such formations have been difficult to achieve because of the generally arcuate transverse cross section of the fender and the fact that the end of the fender is rounded as viewed in plan, being generally semi-circular or of a similarly curving outline.

SUMMARY OF THE INVENTION

The present invention provides a relatively simple forming die structure which forms a flange aong the compound curved edge at the end of a bicycle fender. The compound curve results from the fact that the blank from which the fender is formed has a rounded end and the fender itself, including the rounded end portion, is of arcuate or a similarly curving transverse cross section.

The net result of these two curvatures is that the fender end, prior to the flanging operation performed by the forming die of the present invention, is generally arcuate as viewed in side elevation. The die structure of the present invention consists essentially of a relatively stationary shoe which has an upper surface complementary to the inner surface of the fender to be flanged adjacent to the end portion of the fender.

One end of the shoe is arcuate in side elevation. The movable forming die element comprises a member which has an internally arcuate surface as viewed in side elevation, the radius of such surface being just slightly larger than the arcuate end of the shoe and concentric with such arcuate end. The movable forming die element is mounted for pivotal movement on an axis concentric with the common axis of the arcuate end of the shoe and said internally arcuate movable die surface.

A fender is placed upon the shoe with its end projecting beyond the arcuate end thereof and the movable die element is pivoted downwardly against such projecting portion to bend the same about the arcuate end of the shoe and form a flange at the fender end. The flange thus formed has an included angle of less than 90° with the fender proper so that the desired return bend may be completed by the use of a simple flange flattening die.

DESCRIPTION OF THE ILLUSTRATED EMBODIMENT

Figure 1:
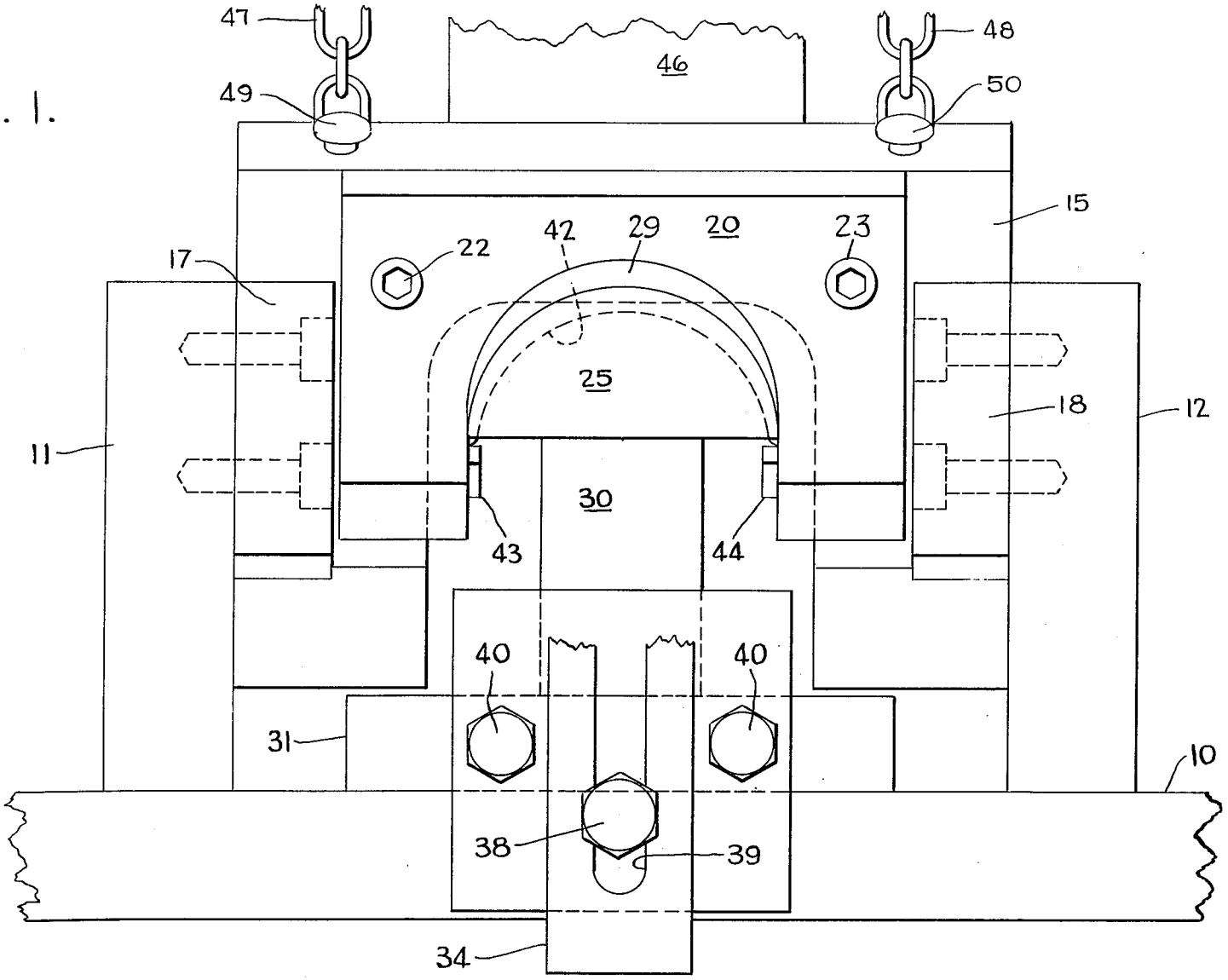
FIG. 1 is a front elevational view of one form of the fender flanging apparatus of the present invention.
Figure 2:
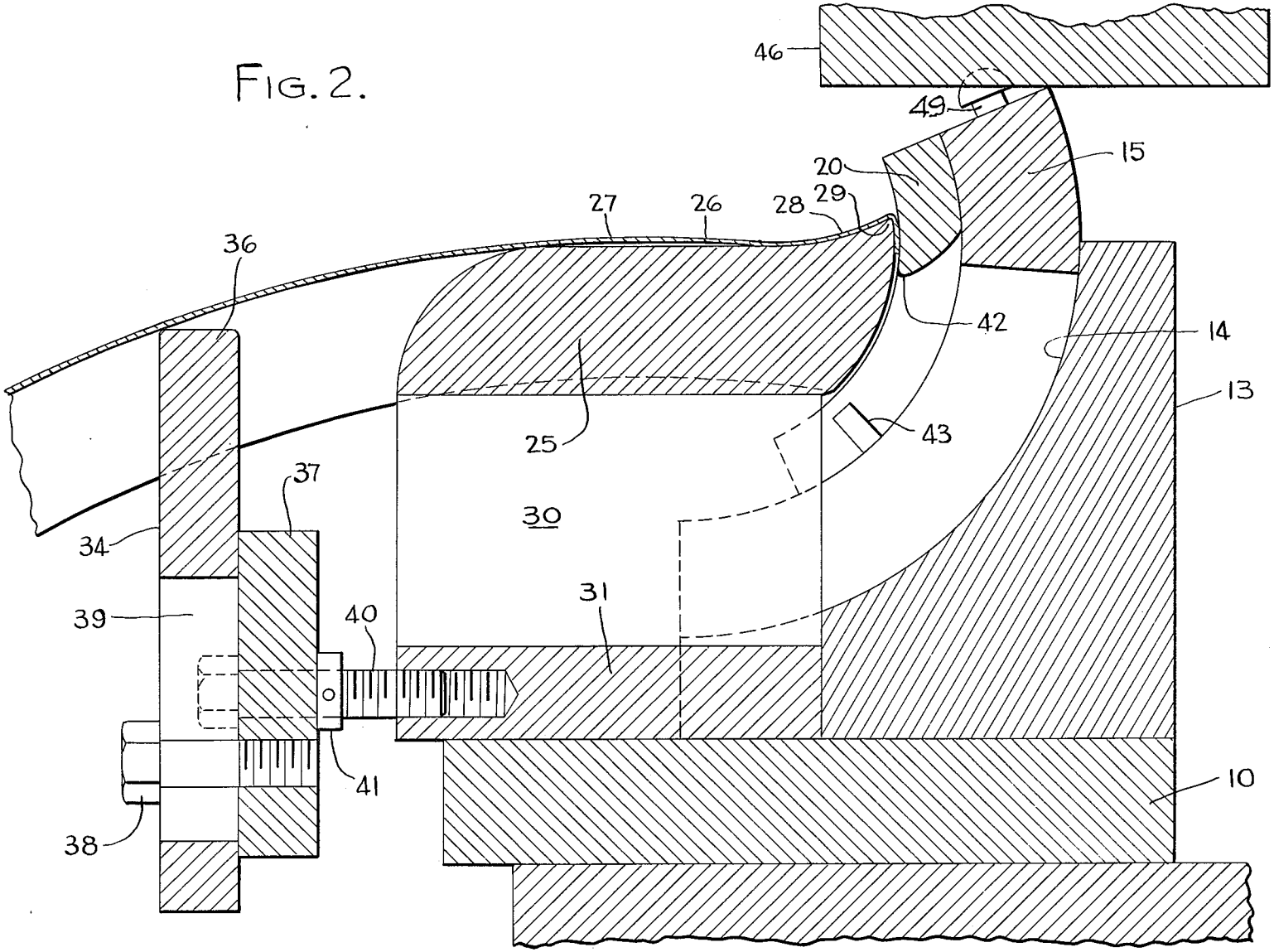
FIG. 2 is a cross sectional view taken generally across FIG. 1.

The rigid frame work of the flanging die structure illustrated in FIGS. 1 and 2 comprises bed plate 10, a pair of side walls 11 and 12 fixed thereto, and a rear wall 13 extending between the side walls 11 and 12 and having an internally arcuate front face portion 14.

The movable portion of the die structure comprises an arcuate member 15 which extends between the side walls 11 and 12 and which is concentric with and in sliding relation with the arcuate surface portion 14 of rear wall 13. For retaining member 15 in such sliding relation a pair of arcuate bars 17 and 18 shown in FIG. 1 are fixed to the interior faces of side walls 11 and 12 and have sliding bearing against the side margins of the internally arcuate front face of member 15.

The arcuately movable flanging die member itself is shown at 20 in FIGS. 1 and 2 and is attached to the front face of member 15 between the arcuate retaining bars 17 and 18 by screws 22 and 23 shown in FIG. 1. Further details of the flanging die member 20 will be described later herein.

Reference will now be had to the companion flange forming member and the workpiece supporting and positioning means. The principal support for the fender to be flanged and the stationary flange forming member comprises a shoe 25 having an upper surface portion 26 adapted to fit within a fender to be flanged. In the illustrated instance a fender shown at 27 in FIG. 2 has a reversely flared end portion 28 and shoe 25 is formed to follow this flare as at 29.

In the present instance the fender is generally arcuate in transverse section and the upper surface 26 of shoe 25 is accordingly half round. However, various show curvatures will be employed with fenders of variously curved cross sections. Shoe 25 is fixed to a support block 30 which in turn is fixed to a base member 31 which is secured to bed plate 10.

The workpiece is further supported during the flanging operation by means which will now be described. A support plate 34 has an upper edge portion 36 and is secured to a plate 37 for vertical adjustment by a screw 38 which passes through a vertical slot 39 in support plate 34. The plate 37 is in turn mounted for horizontal adjustment in a front to rear direction, to this end a pair of screws 40 pass through plate 37 and are held against axial movement relative thereto by collars 41. Screws 40 thread into the base member 31 of shoe 25 and this provides for horizontal adjustment of support plate 34 in an obvious manner. Support plates 34 having various curvatures at their upper ends to engage within fenders having various transverse cross sections are employed.

Referring now to flanging die member 20 which is of generally inverted U-shape to provide an arched rounded forming edge 42. The flanging die member 20 is shown in the drawings in a lowered position with respect to the companion forming edge portion of shoe 25. A pair of gauge members 43 and 44 are attached to the member 20 at the lower portions of the arch formation therein and when the member 20 is in raised position a fender to be flanged is moved rearwardly into the die structures for locating engagement with members 43 and 44.

The means for arcuately raising and lowering member 15 and the forming member 20 which is attached thereto will now be described. It is to be understood that the apparatus of the present invention may be mounted in a conventional punch press although the essential elements of the present invention may be arranged in other ways. In the illustrative embodiment the bed plate 10 is secured to the bed of a punch press in the usual manner.

A block 46 which may comprise a conventional punch holder is carried by the ram of the punch press and is adapted, upon downward movement of the ram, to engage the upper edge of member 15 to move the same arcuately downwardly to perform a fender end flanging operation. For returning the member 15 to its upper position a pair of chain members 47 and 48 are employed in the present instance. The lower ends of chains 47 and 48 are secured to the upper end of member 15 by screws 49 and 50, respectively, and the upper ends of the chains are attached to the ram of the punch press. Various alternative means for raising and lowering members 15 and its attached forming member 20 may be employed.

A preferred embodiment of this invention having been hereinabove described and illustrated in the drawings, it is to be understood that numerous modifications thereof can be made without departing from the broad spirit and scope of this invention as defined in the appended claims.

I claim:

1. Apparatus for forming a flange along the end of a bicycle fender or similar workpiece of curving transverse cross section and having a curved end portion whereby the fender end is of generally arcuate shape as viewed in side elevation, said apparatus comprising a supporting shoe fitting within the fender and having an end portion complementary to the interior of the fender, said end of said shoe being arcuate in side elevation, and a forming member having an internally arcuate surface concentric with the arcuate end of said shoe, means mounting said forming member for pivotal movement on an axis coincident with the common axis of said arcuate surfaces, whereby pivotal movement of said forming member bends the curved fender end portion downwardly across the arcuate end portion of said shoe to form a flange along said curved end portion.

2. Apparatus according to claim 1 including power means for successively lowering and raising said forming member by pivotal movement thereof.

3. Apparatus according to claim 1 wherein said forming member has an inverted U-shaped opening therein to provide a correspondingly shaped forming edge adapted to overlie the fender end and form a flange thereon upon arcuate downward movement of said forming member.

4. Apparatus according to claim 3 having gauging elements projecting inwardly from the walls of said U-shaped opening in alignment with the fender edge when the forming member is in raised position to limit the overhang of the fender edge relative to the arcuate forming end portion of said shoe to determine the width of the flange.

5. Apparatus according to claim 1 including a support disposed forwardly of said shoe and engageable within a fender to cooperate with said shoe in positioning a fender for flanging.

6. Apparatus according to claim 5 wherein said support is vertically adjustable.

7. Apparatus according to claim 5 wherein said support is adjustable toward and away from said shoe.

* * * * *